United States Patent [19]

Nishio et al.

[11] 4,144,474

[45] Mar. 13, 1979

[54] LOW NOISE RESISTANCE CONTAINING SPARK PLUG

[75] Inventors: Kanemitsu Nishio; Shunichi Takagi, both of Nagoya, Japan

[73] Assignee: NGK Spark Plug Co., Ltd., Nagoya, Japan

[21] Appl. No.: 809,246

[22] Filed: Jun. 23, 1977

[30] Foreign Application Priority Data

Jun. 29, 1976 [JP] Japan ..... 51-76869

[51] Int. Cl.[2] ..... H01T 1/16; H01T 12/20

[52] U.S. Cl. ..... 315/53; 315/58; 313/131 A

[58] Field of Search ..... 315/58, 52, 53; 313/131 A, 131 R

[56] References Cited

U.S. PATENT DOCUMENTS

| | | | |
|---|---|---|---|
| 3,037,140 | 5/1962 | Schurecht | 313/131 A |
| 3,890,518 | 6/1975 | Tombs | 313/131 A X |

*Primary Examiner*—Alfred E. Smith
*Assistant Examiner*—Charles F. Roberts
*Attorney, Agent, or Firm*—Sughrue, Rothwell, Mion, Zinn and Macpeak

[57] ABSTRACT

A spark plug is disclosed which is used for an internal combustion engine such as an automobile. The spark plug has a carbonaceous resistance sandwiched between its spark rod electrode and its terminal rod in the central through hole of an elongated hollow cylindrical ceramic insulator. The spark electrode is made of a heat and spark resisting semiconductive resistance material, is sealed integrally with the carbonaceous resistance in the central through hole of the insulator, and produces a spark discharge between a grounded electrode spaced therefrom by a predetermined gap. The spark plug of the above-mentioned construction enables the intensity of a noise wave produced upon the spark discharge to be suppressed to the lowest possible level.

2 Claims, 3 Drawing Figures

LOW NOISE RESISTANCE CONTAINING SPARK PLUG

BACKGROUND OF THE INVENTION

The present invention relates to a spark plug used for an internal combustion engine such as an automobile, and more particularly to an improvement in a resistance containing spark plug which functions to suppress a noise or jamming wave component generated at its spark discharge.

In order to lower the level of a noise wave component in a frequency region higher than 300 MHz, it is generally desirable to provide a resistance, in proximity to the spark gap of the spark plug, which acts to suppress noise current produced at the moment of its spark discharge. For this purpose, a resistance containing spark plug which is constructed to seal a resistance having a length longer than 7 mm in proximity to its spark gap between its spark rod electrode made of nickel alloy and its terminal rod specially disposed in the central through hole of an elongated hollow cylindrical ceramic insulator, was disclosed in the Japanese patent application Nos. 79130/71 and 42777/76 by the same assignee. The former was laid open as OPI No. 45725/73, and the latter was laid open on Oct. 22, 1977. The present inventor' experiments have proved that such a resistance containing spark plug enabled the noise level generated at the time of discharge to be greatly lowered, but was yet unsatisfactory.

SUMMARY OF THE INVENTION

It is accordingly an object of the invention to provide a resistance containing spark plug capable of further improving its noise suppressing effect.

The object of the invention is attained by a resistance containing spark plug in which its spark electrode is made of a heat and spark resisting semiconductive resistance material, the spark electrode having a portion exposed at the side of the spark discharge of the spark plug to be produced between a grounded electrode thereof spaced by a predetermined gap from the spark electrode.

BRIEF DESCRIPTION OF THE DRAWINGS

The invention will be more fully understood from the following description taken in conjunction with the accompanying drawings, in which.

PREFERRED EMBODIMENTS OF THE INVENTION

Figure 1:
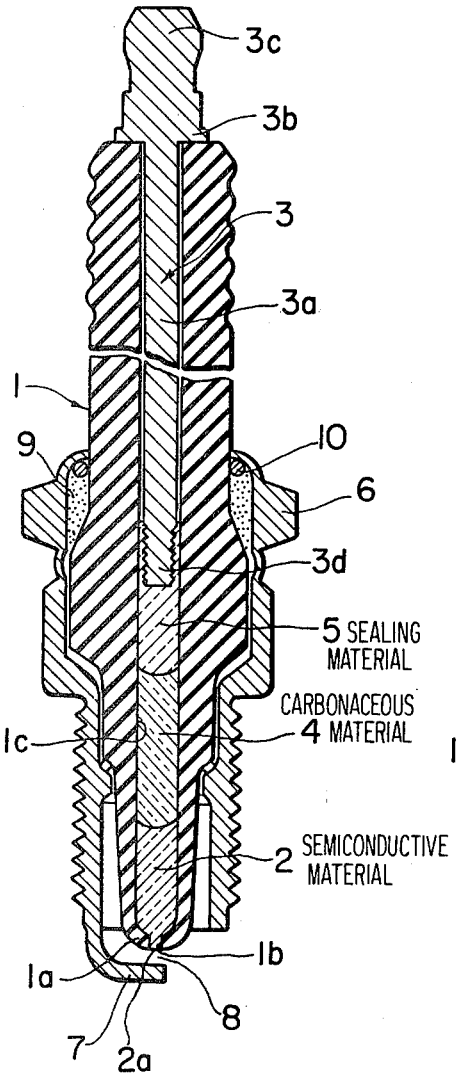
FIG. 1 is a cross sectional view of a resistance containing spark plug embodying the invention.

Referring now to FIG. 1, reference numeral 1 designates a heat resisting elongated hollow cylindrical insulator made, e.g., of a high alumina porcelain and having a through hole 1*c* formed at its longitudinal center so as to facilitate the press formation of the hereinunder described resistance materials 2, 4 and 5 to be sealed in the through hole 1*c*. The spark discharge end 1*a* of the insulator 1 is inwardly bent to form a small hole 1*b* communicating with the through hole 1*c* and having a smaller diameter than the through hole 1*c*. Thus, according to the invention, the hereinafter described semiconductive resistance material 2, carbonaceous resistance material 4 and sealing resistance material 5 are introduced in turn from the upper end of the insulator 1 into the through hole 1*c* and then heated for about ten minutes at a temperature of about 900° to 1100° C., to thereby simultaneously soften them.

Under this condition, a terminal rod 3 is pressed from the upper end of the insulator 1 into the through hole 1*c* thereof so that its lower end portion 3*d* is fixedly received in the subsequently soldified sealing resistance material 5 and a soldified, exposed spark electrode portion 2*a* is formed by the lowest portion of the semiconductive resistance material 2 in the small hole 1*b*, the terminal rod 3 comprising a rod like portion 3*a* inserted into the through hole 1*c* of the insulator 1 in the above-mentioned manner and having its lower portion 3*d* fixedly received in the soldified sealing resistance material 5 by means, e.g., of threading or knurling formed around its periphery. A flange portion 3*b* projects outwardly from the upper end of the rod like portion 3*a* and contacts the upper end of the insulator 1 when the terminal rod 3 is pressed into the through hole 1*c* of the insulator 1 in the above-mentioned manner, and a terminal portion 3*c* connects to an external cable connector (not shown). The elongated insulator 1 thus obtained is secured through a sealing powder 9 such as talc and an annular metal packing 10 such as aluminum in a metal shell 6 for installing the spark plug in an internal engine such as an automobile (not shown). A grounded electrode 7 is projected laterally from the lower end of the metal shell 6 so as to form a predetermined spark gap 8 between the aforesaid exposed spark electrode portion 2*a*.

The semiconductive resistance material 2 has the necessity of producing a spark discharge in a burning gas of a high temperature of about 800° to 850° C. and in consequence has the hazard of misfire because oxidization is remarkably scattered in the material 2 and the voltage of the spark discharge is rapidly increased for a short period of time. For this reason, the semiconductive resistance material 2 is comprised of a mixture of a heat and spark resisting, heat conductive metal, metal allow, metal oxide and/or carbonized metal powder; a heat and oxidation resisting inorganic substance; and a sealing glass having a high melting point suitable for the aforesaid sealing process. The resultant mixture is chosen to have a relatively low d.c. resistance of about 10 to 1000Ω. More particularly, chromium, platinum, paladium, indium and/or rhodium powder is usable for the metal powder of the material 2; a compound of nickel and chromium, of iron and boron and/or of gold and paladium is usable for the allow powder thereof; and a compound of silicon dioxide, aluminum oxide and boron oxide is usable for the sealing glass thereof.

Figure 3:
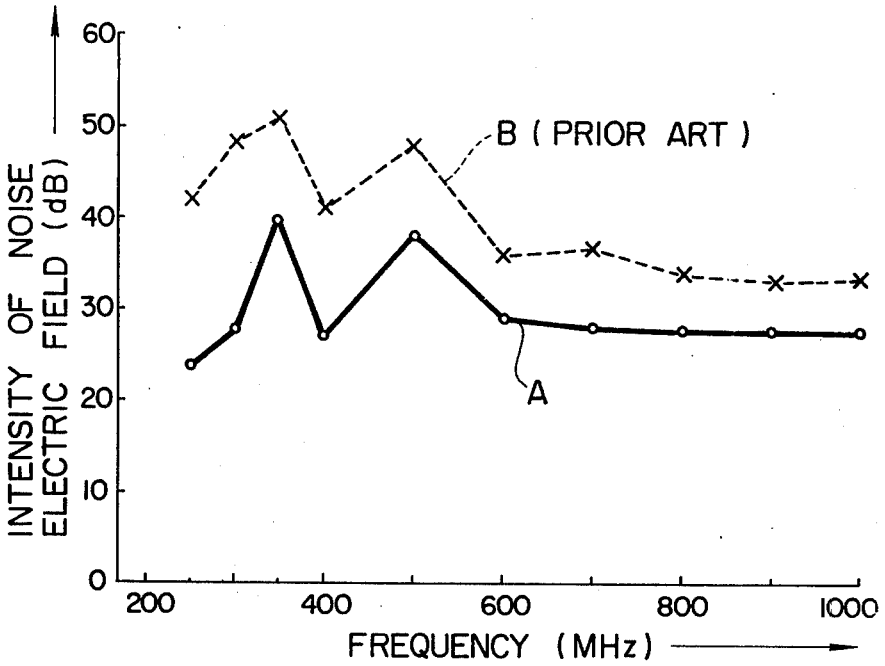
FIG. 3 is a curve diagram comparing the intensity of an electric noise field produced by a resistance containing spark plug according to the invention with that produced by a prior art resistance containing spark plug.

The carbonaceous resistance material 4 may be a conventional one whose main components consist of glass, aggregate and carbon, and is chosen to have a relatively high d.c. resistance of about 1kΩ to 5kΩ for suppressing spark noise in the low frequency region from 30 MHz to 300 MHz (see FIG. 3).

The sealing resistance material 5 may comprise a conventional conductive glass in which an appropriate metal powder is mixed, or to which an appropriate semiconductive substance such as a metal oxide is further added, and is chosen to have a relatively low d.c. resistance of about 10 to 100Ω.

A practical low noise resistance containing spark plug particularly suitable for an automobile constructed in accordance with the embodiment of FIG. 1 will be described hereinunder.

(1) The elongated hollow cylindrical high alumina porcelain insulator 1 having the following dimensions is first prepared. Namely, the insulator 1 has a length of about 65.5 mm and a lower end wall thickness of about 0.5 to 1.0 mm, the through hole 1*c* has a diameter of about 3.6 mm, and the spark discharge hole 1*b* has a diameter of about 1.0 mm and a height of about 0.5 mm.

(2) The semiconductive resistance material 2 which is comprised of a mixture of compound glass powder 30% by weight of silicon oxide, aluminum oxide and boron oxide; the alloy powder 30% by weight of iron and boron; titanium oxide powder 10% by weight; lanthanum chromite 10% by weight; chrominum carbide powder 10% by weight; and alumina 10% by weight is introduced into the through hole 1*c* to a height of about 5 mm starting from the spark end of the insulator 1.

(3) The carbonaceous resistance material 4 which comprises a mixture of barium borate glass powder 40% by weight, zirconium powder 60% by weight and methyl cellulose carbonaceous material 1 to 4% by weight is then inserted into the through hole 1*c* with a height of about 7 mm starting from the upper surface of the semiconductive resistance material 2.

(4) The sealing resistance material 5 which comprises the same components as the semiconductive resistance material 2 excepting that said compound glass powder is replaced by a borosilicate glass having a slightly lower melting point than that of the former and a tin powder 5% by weight for enhancing the adhesive force to the terminal rod 3 is added thereto, is introduced into the through hole 1*c* to a height of about 2 mm.

(5) The insulator 1 thus prepared is heated for about ten minutes at a temperature of about 900° to 1100° C., thus softening all the aforesaid resistance materials 2, 4 and 5 in the through hole 1*c*.

(6) Under this condition, the rod like portion 3*a* of the terminal rod electrode 3 having a length of about 51.5 mm is pressed into the through hole 1*c* of the insulator 1 in the above-mentioned manner.

(7) Finally, the insulator 1 thus obtained is installed in a 14 mm threaded type engine metal shell 6 in a conventional manner.

The solid curve A of FIG. 3 shows the average value of the five spark plugs prepared in the above-mentioned manner according to the invention and measured on the basis of the regular experiment of Japan Radio Technical Committee, while the dotted curve B indicates that of the following five prior art spark plugs. Namely, the prior art spark plug uses an elongated hollow cylindrical high aluminum porcelain insulator which has at its longitudinal center a through hole consisting of a small lower or spark discharge side hole section of a length of about 14 mm and a diameter of about 2.8 mm, and a large upper hole section of a length of about 50.5 mm and a diameter of about 3.6 mm. In the small hole section of the through hole is received a nickel alloy electrode rod provided at its top with a flange. Substantially the same two layer resistance materials as the aforesaid sealing resistance material 5 are introduced into the large hole section of the through hole with substantially the same single layer resistance powder as the aforesaid carbonaceous resistance material 4 sandwiched therebetween. Under this condition, the insulator is heated for about seven minutes at the temperature of about 900° to 1000° C., then the same terminal rod as the aforesaid terminal electrode 3 is pressed into the through hole, and finally the insulator is installed in a prescribed engine metal shell.

As will be evident from FIG. 3, the spark plug of the invention can attain a more excellent noise suppressing effect than in the prior art spark plug. In FIG. 3, the abscissa indicates the frequencies of a noise wave while the ordinate indicates the intensity of the electric noise field.

Figure 2:
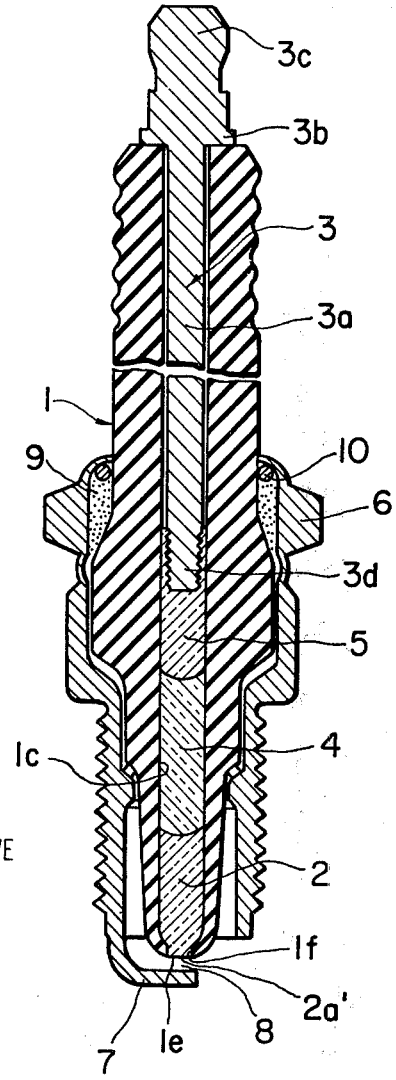
FIG. 2 is a cross sectional view of another resistance containing spark plug embodying the invention.

FIG. 2 is a schematic cross sectional view of another spark plug embodying the invention.

The spark plug of FIG. 2 has the same construction as that of FIG. 1, excepting that the small diametric hole 1*b* of FIG. 1 is closed or not provided in the insulator 1 of FIG. 2, and coated around a closed lower end wall 1*e* is the pasty semiconductive material, e.g., of chromium oxide, or chrominum fluoride, the mixture powder of the chromium oxide or chromium fluoride and manganese oxide 5% by weight.

Alternatively, such a semiconductive material is introduced in the lowest section 1*f* of the through hole, dried, heated at a temperature of about 350° C. per hour in a furnace and finally heat-treated for about two hours at a temperature of about 1450° C., so that $Cr^{+3}$ ion is permeated into the high alumina porcelain insulator to form a semiconductive spark electrode portion 2*a*'.

It will be apparent to those skilled in the art that the spark plug of FIG. 2 has substantially the same noise suppressing effect as that of FIG. 1 as well as enables to make the life time longer than that of FIG. 1.

What we claim is:

1. In a resistance containing spark plug comprising an elongated hollow cylindrical heat resisting insulator having a central longitudinal through hole; a spark electrode received in and partially exposed from the spark end of the insulator through hole; a noise suppressing resistance material inserted into the through hole of the insulator and having a predetermined height starting from the upper end of the spark electrode; a terminal electrode having an inner portion secured in the through hole of the insulator in contact with the resistance material and an outer portion adapted to be connected to an external power source; and a ground electrode spaced by a predetermined gap from the spark electrode, the improvement characterized by: (a) said spark electrode comprising a semiconductive material having a relatively low electrical resistance, relatively high resistances to sparking and heat deterioration, relatively high thermal conductivity, and relatively high resistance to oxidation, said semiconductive material comprising a first main component of high melting point sealing glass composition containing $SiO_2$, $Al_2O_3$ and $B_2O_3$, a second main component of metal alloy powder having a high oxidation resistance at high temperatures, and lesser amounts of oxides and inorganic substances, (b) said noise suppressing resistance material comprising a carbonaceous layer above the spark electrode and having a relatively high electrical resistance, and a sealing layer above the carbonaceous layer and having a relatively low electrical resistance and high adhesion properties, said sealing layer being in contact with the terminal electrode, and (c) the spark end of the insulator through hole being at least partially closed to define a reduced diameter end opening.

2. The spark plug claimed in claim 1, wherein the spark end of the insulator is fully closed, and said semiconductive resistance material is introduced into the closed end portion of the insulator and permeated into the insulator material by heating.

* * * * *